United States Patent [19]

Wasserstrom et al.

[11] Patent Number: 4,954,802

[45] Date of Patent: Sep. 4, 1990

[54] BI-METAL TEMPERATURE SWITCH

[75] Inventors: Henry Wasserstrom; Viorel Drambarean, both of Chicago, Ill.

[73] Assignee: Stewart Warner Instrument Corporation, Chicago, Ill.

[21] Appl. No.: 354,498

[22] Filed: May 19, 1989

[51] Int. Cl.[5] ..... H01H 37/04; H01H 37/52

[52] U.S. Cl. ..... 337/380; 337/372

[58] Field of Search ..... 337/380, 379, 372, 374, 337/375, 368, 362

[56] References Cited

U.S. PATENT DOCUMENTS

| | | | |
|---|---|---|---|
| 2,751,464 | 6/1956 | Short et al. | 337/379 |
| 3,171,933 | 3/1965 | Webb et al. | 337/380 |
| 3,221,125 | 11/1965 | Young | 337/362 |
| 3,234,350 | 2/1966 | Johnson et al. | 337/380 |
| 3,246,107 | 4/1966 | Ebensteiner | 337/379 |
| 4,413,247 | 11/1983 | Hire | 337/380 |
| 4,514,717 | 4/1985 | Doherty, Jr. | 337/380 |

*Primary Examiner*—H. Broome

*Attorney, Agent, or Firm*—Lorusso & Loud

[57] ABSTRACT

A temperature switch assembly which includes a bimetal element inserted into a holder body and secured in place by a mating shell is presented. The holder body is constructed so that it may be screwed into existing bore holes of the vessel or engine. The bimetal element is formed with tangs on its base so that expansion and contraction effects due to temperature changes are compensated thus ensuring calibration of temperature switch over prolonged usage. The mating shell includes a switch contact. When the bimetal element reaches a predetermined temperature, the bimetal element makes contact with the switch contact and completes the circuit. The circuit is connected to a warning device which is actuated when the circuit is completed.

6 Claims, 2 Drawing Sheets

BI-METAL TEMPERATURE SWITCH

BACKGROUND OF THE INVENTION

The present invention relates to bimetal temperature switches.

In many applications it is crucial to know whether the temperature in a reactor., vessel or engine has exceeded a predetermined set point. When such an event occurs, an alarm should sound or some other action should occur. A simple yet effective way to accomplish this function is through the use of thermostatic bimetal strip.

A thermostatic bimetal strip is defined as a composite material, made up of two or more metal strips fastened together. This composite, because of the different expansion rates of the component strips, tends to change curvature when subjected to a temperature change.

With one end of the strip fixed, the other end deflects when subjected to a temperature change. The bimetal strip is positioned so that after it deflects a certain amount it makes contact with a lead and thereby completes a circuit. The point at which the circuit is completed corresponds to certain deflection of the bimetal strip and a certain temperature. This circuit is connected to a warning light, alarm annunciator or some other device to indicate that the temperature has been exceeded.

Although devices using this principal are well known, there are problems that occur with known devices. Usually the bimetal strip is crimped into a copper temperature well. Because of this design, the bimetal element is subject to "shift" prior to use. The shift in the strip alters the high or low temperature signal that the device measures, thereby giving inaccurate readings. The shift can occur because the copper temperature well can deform slightly due to handling prior to installation. This shifts the position of the bimetal strip. Another problem of the known devices is that a separate hole into the vessel or engine needs to be provided to mount the copper temperature well. The present invention solves these problems in a unique and economical manner.

SUMMARY OF THE INVENTION

The apparatus of the present invention includes a temperature sensing bimetal element which is dropped or inserted into place within an existing holder body. The holder body is part of the metal probe which screws into an existing threaded bore of the vessel or engine. A mating shell is screwed into threads of holder body which secures the bimetal element. Tangs on the base of the bimetal element compensate for expansion and contraction effects due to temperature changes within the vessel or engine. These tangs keep the bimetal strip from shifting, thus the temperature switch stays calibrated. A high temperature plastic is used as an electric insulator within the mating shell. The bimetal element is in intimate contact with the metal probe to obtain accurate thermal response. The body, with the probe, is massive in comparison to the sensitive bimetal element to ensure the calibration of the bimetal element.

It is an object of the present invention to provide an economical temperature switch offering operational temperature set points even in excess of 600° F.

It is a further object of the present invention to provide a temperature switch which is accurate even after repeated exposure to extreme hot and cold temperatures.

Another object of the present invention is to provide a temperature switch which has improved construction over known temperature switches.

These and other features and objects of the present invention will be more fully understood from the following detailed description and drawings which follow.

DESCRIPTION OF THE PREFERRED EMBODIMENT

Figure 1:
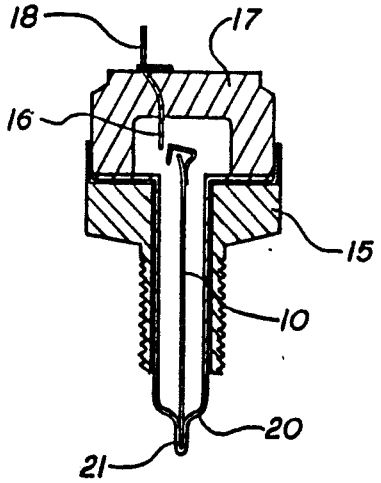
FIG. 1 (PRIOR ART)
FIG. 1 shows a known temperature switch using a bimetal element.

A known temperature switch is shown in FIG. 1. The temperature well 20 , which is generally made of copper, is inserted into the vessel or engine (not shown) whose temperature is being monitored. The temperature well 20 is held in place by a threaded bolt 15 which screws into the vessel. A contact element 16 is seCured within the bolt 15 by insulating material 17 which electrically insulates the contact element 16 from the threaded bolt 15. Electrical lead 18 is in electrical contact with the contact element 16 and the lead 18 is also electrically insulated from threaded bolt 15. The temperature well 20 holds a bimetal temperature element 10. The bimetal element 10 is secured to the temperature well 20 by crimping the end 21 of the temperature well 20.

The temperature switch of FIG. 1 works in the following manner. The well 20 is inserted into a vessel or engine and secured by tightly screwing in threaded bolt 15. As the temperature of the interior of the vessel or engine increases, the bimetal element 10 bends forward due to the different expansion rates of the metal strips of the bimetal element. At a certain temperature, the bimetal element 10 touches contact element 16 which completes the circuit. The circuit is attached to some device which indicates the vessel has reached or exceeded a certain temperature.

The drawbacks of the device in FIG. 1 are as follows. Due to the possibility of mis-handling deforming the end 21 of the temperature well 20 prior to installation, the bimetal element may not be aligned properly and therefore the calibration of the temperature switch may be in error. Another drawback to this device is that fluid tight seals are required between the copper temperature well 20 and the threaded bolt 15. This increases cost of the temperature switch.

Figure 5:
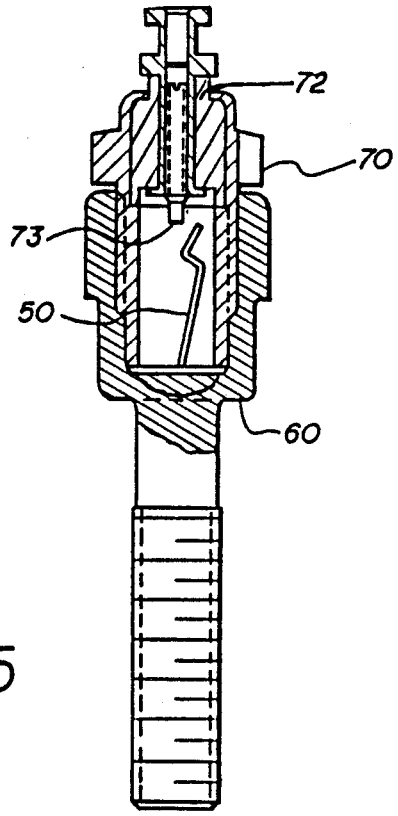
FIG. 5 shows a cross-sectional view of the temperature switch of the present invention.

The present invention solves these problems in a convenient and economical way. Shown in FIG. 5 is a cross-sectional view of the temperature switch assembly of the present invention. The assembly consists of three elements. A threaded probe 60 which is screwed into an existing bore hole of the vessel or engine. A bimetal strip 50 which is inserted into the probe 60 and a mating shell 70 which secures the bimetal element 50 to the probe.

Figure 2:
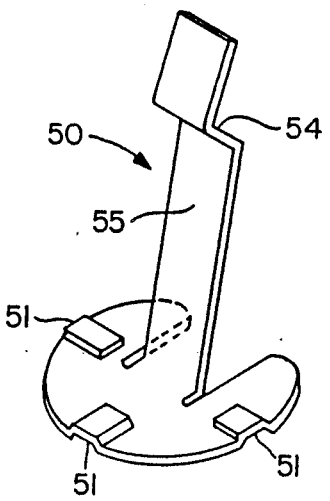
FIG. 2 shows an isometric view of the bimetal temperature element of the present invention.
Figure 3:
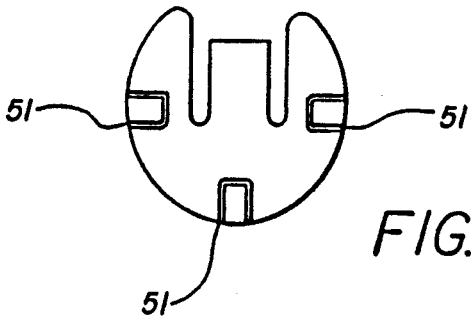
FIG. 3 shows an underside view of the bimetal temperature element of the present invention.

The first element, the bimetal strip 50, is shown in FIGS. 2 and 3. FIG. 2 is an isometric view of the bimetal strip 50. The bimetal element has a high expanding side 54 and a low expanding side 55. Tangs 51 are formed on the upper part of the bottom surface. These tangs compensate for expansion and contraction effects due to temperature changes so that the strip 50 is always in proper alignment within the switch assembly. FIG. 3 shows the bottom of the bimetal strip with the tangs 51. This element is dropped into the temperature probe 60 of the switch assembly.

Figure 4:
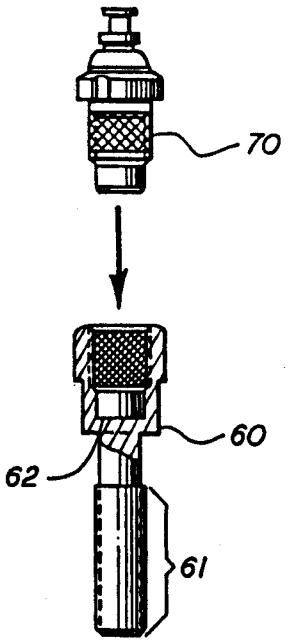
FIG. 4 shows the mating shell and temperature probe of the present invention.

FIG. 4 shows the temperature probe 60, which screws into a vessel or engine block. The probe 60 is manufactured such that the threads not shown along 61 match an existing threaded bore within the vessel or engine so that no additional hole needs to be provided. The head of the probe 60 is manufactured so that there is an indentation 62. The bimetal element 50 is dropped into this indentation so that the bottom of the bimetal element 50 rests on the bottom of the indentation 62. Also shown in FIG. 4 is the mating shell 70 which screws into the threads of indentation 62 to hold the bimetal element 50 in place.

FIG. 5 shows a cross-sectional view of the temperature switch assembly of the present invention. The bimetal strip 50 is secured into the indentation 62 of probe 60. The mating shell 70 screws into the indentation 62 of the probe 60 and secures the bottom surface of the bimetal element 50 to the bottom surface of the indentation 62. Because of the intimate contact between the two bottom surfaces, the temperature of the bimetal element 50 is equal to the temperature of the probe. The mating shell is constructed so that there is a switch contact 73 which protrudes into the space formed by the mating shell and the indentation 62. The switch contact 73 is electrically insulated from the rest of the mating shell 70 by insulation 72. The switch contact 73 is electrically connected to a monitor device which is not shown.

The temperature switch assembly is screwed into an existing bore hole or existing temperature well hole in a vessel or engine. As the temperature in the vessel or engine increases, the temperature of the bimetal element also increases. This causes the element 50 to deflect toward the switch contact 73 as the high expanding side 54 expands more than the low expanding side 55. When the element 50 makes contact with the switch contact 73, the circuit is complete and a warning device is actuated. This event can be made to occur at any desired temperature depending on the construction of the bimetal element. In a preferred embodiment, the bimetal element is invar-iron alloy which is subsequently silver plated.

The invar-iron alloy refers to two metal strips fastened together. The invar alloy refers to a metal that is composed of 36–39 percent nickel and 61–64 percent iron. The iron alloy refers to an alloy which is composed of 18–22 percent nickel, 2–11 percent chromium and the remainder being iron. In a preferred embodiment the bimetal temperature element is made from a low expanding metal of 36 percent nickel and 64 percent iron and a high expanding metal made of 19–22 percent nickel, 2–3 percent chromium and the remainder being iron. With this bimetal, the temperature range of useful deflection is −100° F. to 700° F. and the range of maximum sensitivity is 0° F. to 100° F.

A useful way measure the properties of a bimetal element is flexivity. Flexivity is defined as the change in curvature of bimetals per unit temperature change for unit thickness. It is determined by the formula:

$$F = \frac{\left(\frac{1}{R_2} - \frac{1}{R_1}\right)^t}{T_2 - T_1}$$

where

F is the flexivity;

$R_2$ is the final radius of curvature of the longitudinal center line of the strip;

$R_1$ is the initial radius of curvature of the longitudinal center line of the strip;

t is the thickness of the strip in inches;

$T_2$ is the final temperature in degrees Fahrenheit; and $T_1$ is the initial temperature is degrees Fahrenheit.

In the bimetal strip of the present invention the initial specimen has no apparent initial irregularity of curvature. The width of the bimetal element is approximately 5–10 times the thickness. The flexivity of the bimetal is dependent on composition and is approximately $10\text{–}20\times10^{-6}\pm4\%$ for the materials mentioned.

While the foregoing invention has been described with reference to its preferred embodiment, various alterations and modifications will occur to those skilled in the art. For example, different metals may be used to make the bimetal element so that switch contact occurs at any desired temperature. These and other embodiments are intended to fall within the scope of the appended claims.

What is claimed is:

1. A temperature switch assembly comprising:

a probe which is threaded at one end and has an indentation at the other end wherein the indentation is internally threaded and has a flat bottom surface;

a bimetal element having a flat surface and extension projecting away from the flat surface wherein the bimetal element is inserted into the indentation of the probe so that the flat surface of the bimetal element matches the bottom flat surface of the indentation;

a mating shell which screws into the indentation of the probe securing the bimetal element in the indentation, wherein the mating shell has a switch contact projecting into an open space created by the indentation of the probe and the mating shell, the switch contact being electrically insulated from the mating shell;

wherein the bimetal element deforms and makes contact with the switch contact when the temperature of the bimetal element reaches a predetermined value.

2. The temperature switch assembly according to claim 1 wherein the threads on the threaded end of the probe match an existing threaded bore in a vessel or engine.

3. The temperature switch assembly according to claim 1 wherein the bimetal element has tangs opposite the bottom surface.

4. A temperature switch assembly comprising:

a probe which is threaded at one end and has an indentation at the other end wherein the indentation is internally threaded and has a bottom surface;

a bimetal element having a surface and extension projection away from the surface wherein the bimetal element is inserted into the indentation of the probe so that the surface of the bimetal element matches the bottom surface of the indentation;

a mating shell which screws into the indentation of the probe securing the bimetal element in the indentation, wherein the mating shell has a switch contact projecting into an open space created by the indentation of the probe and the mating shell, the switch contact being electrically insulated from the mating shell;

wherein the bimetal element deforms and makes contact with the switch contact when the temperature of the bimetal element reaches a predetermined value.

5. The temperature switch assembly according to claim 4 wherein the threads on the threaded end of the probe match an existing threaded bore in a vessel or engine.

6. The temperature switch assembly according to claim 4 wherein the bimetal element has tangs opposing the bottom surface.

* * * * *